US011684098B1

(12) United States Patent
Wright

(10) Patent No.: US 11,684,098 B1
(45) Date of Patent: Jun. 27, 2023

(54) INTRAVENOUS TUBE COMPATIBLE GARMENT DEVICE

(71) Applicant: Deanna Wright, Santa Ana, CA (US)

(72) Inventor: Deanna Wright, Santa Ana, CA (US)

( * ) Notice: Subject to any disclaimer, the term of this patent is extended or adjusted under 35 U.S.C. 154(b) by 0 days.

(21) Appl. No.: 17/697,027

(22) Filed: Mar. 17, 2022

(51) Int. Cl.
*A41D 13/12* (2006.01)

(52) U.S. Cl.
CPC .... *A41D 13/1245* (2013.01); *A41D 2300/322* (2013.01)

(58) Field of Classification Search
CPC ..... A41D 13/1245; A41D 13/1281; A41D 1/002; A41D 2300/322; A41D 1/215; A41D 13/1236; A41D 13/1263; A41D 13/1272; A41D 13/129; A41D 1/04; A41D 1/18; A41D 1/21; A41D 10/00; A41D 2300/30; A41D 2300/324; A41B 1/02; A41B 1/10; A41B 1/18; A41B 1/22; A41B 1/08
USPC ..... 2/114, 104, 96
See application file for complete search history.

(56) References Cited

U.S. PATENT DOCUMENTS 273,906 A * 3/1883 Sperling ..... A41B 1/10 2/128
274,520 A * 3/1883 Schneer ..... A41B 1/10 2/128
317,417 A * 5/1885 Price ..... A41B 1/10 2/128
890,614 A * 6/1908 Culver ..... A41D 1/215 2/104
1,098,155 A * 5/1914 Knapp ..... A41D 1/215 2/104
1,626,024 A * 4/1927 Crane ..... A41B 9/08 2/104
4,004,294 A * 1/1977 Pinch ..... A41D 1/215 2/104
5,293,840 A * 3/1994 Wedlick ..... A41D 13/1236 128/874
6,032,289 A * 3/2000 Villapiano ..... A41D 13/1245 2/102
6,151,715 A * 11/2000 Doherty ..... A41D 13/1245 2/48
6,438,758 B1 8/2002 Burkard
6,647,552 B1 * 11/2003 Hogan ..... A41D 13/1245 2/114
7,418,741 B2 9/2008 Rogers
7,942,856 B2 5/2011 Lentini
D794,276 S 8/2017 Robertson
D901,839 S 11/2020 Cain
D925,868 S 7/2021 Woluschulk
(Continued)

FOREIGN PATENT DOCUMENTS

WO WO2007056138 5/2007

*Primary Examiner* — Amy Vanatta

(57) ABSTRACT

An intravenous tube compatible garment device for concealing intravenous tubing using a shirt with a flap includes a shirt. The shirt has a front surface. A flap is positioned on the front surface. A top edge of the flap is stitched to the flap and the bottom edge of the flap can flip over. A hidden area is positioned between the flap and the shirt. An opening is positioned in the hidden area. An intravenous tube can be threaded through the opening of the hidden area. A button of the hidden area can retain the flap to the shirt by inserting into a hole of the flap. A zipper is positioned on the front surface. A path of the zipper goes from the base of the shirt to the opening of the hidden area of the flap.

18 Claims, 6 Drawing Sheets

(56) References Cited

U.S. PATENT DOCUMENTS

| | | | | |
|---|---|---|---|---|
| 11,202,477 | B1 * | 12/2021 | Dawson | A41D 31/02 |
| 11,382,371 | B2 * | 7/2022 | Bentley | A41D 27/201 |
| 2006/0037124 | A1 * | 2/2006 | Cho | A41D 13/1245 2/114 |
| 2012/0005803 | A1 | 1/2012 | Sagami | |
| 2012/0117710 | A1 * | 5/2012 | Lenzen | A41D 13/1245 2/114 |
| 2014/0310850 | A1 | 10/2014 | Hudak | |
| 2015/0101102 | A1 | 4/2015 | Theodossiou | |
| 2015/0374048 | A1 * | 12/2015 | Theodossiou | A41D 13/1245 2/114 |
| 2019/0037166 | A1 * | 1/2019 | Davis | A45C 13/1092 |
| 2019/0261707 | A1 * | 8/2019 | Cain | A41D 13/1245 |

* cited by examiner

INTRAVENOUS TUBE COMPATIBLE GARMENT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to medical tubing compatible garments and more particularly pertains to a new medical tubing compatible garment for concealing intravenous tubing using a shirt with a flap.

(2) Description of Related Art Including Information Disclosed Under 37 CFR 1.97 and 1.98

The prior art relates to medical tubing compatible garments. Known prior art includes a variety of garments having a flap on the surface of the garment to cover the opening where medical tubing is positioned. Know prior art lacks a garment having a zipper and a flap to cover an intravenous tube where the flap secures to said garment by a button.

BRIEF SUMMARY OF THE INVENTION

An embodiment of the disclosure meets the needs presented above by generally comprising a shirt. The shirt is a top garment. The shirt has a front surface. The shirt is configured for being worn on the torso of a user whereby the front surface is positioned in front of the user. A flap is positioned on the front surface of the shirt. The flap has a top edge and a bottom edge. The flap has a hole. The top edge of the flap is coupled to the front surface. A hidden area is positioned between the flap and the front surface. The hidden area defines a space where an opening is positioned. The opening is configured for an intravenous tube to be inserted through the shirt. The hidden area has a button. The button is configured for be inserted through the hole of the flap whereby retaining the flap to the shirt. A zipper is positioned on the front surface of the shirt. The zipper has a path. The path of the zipper is positioned at a base of the shirt and protrudes toward the opening of the hidden area of the shirt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
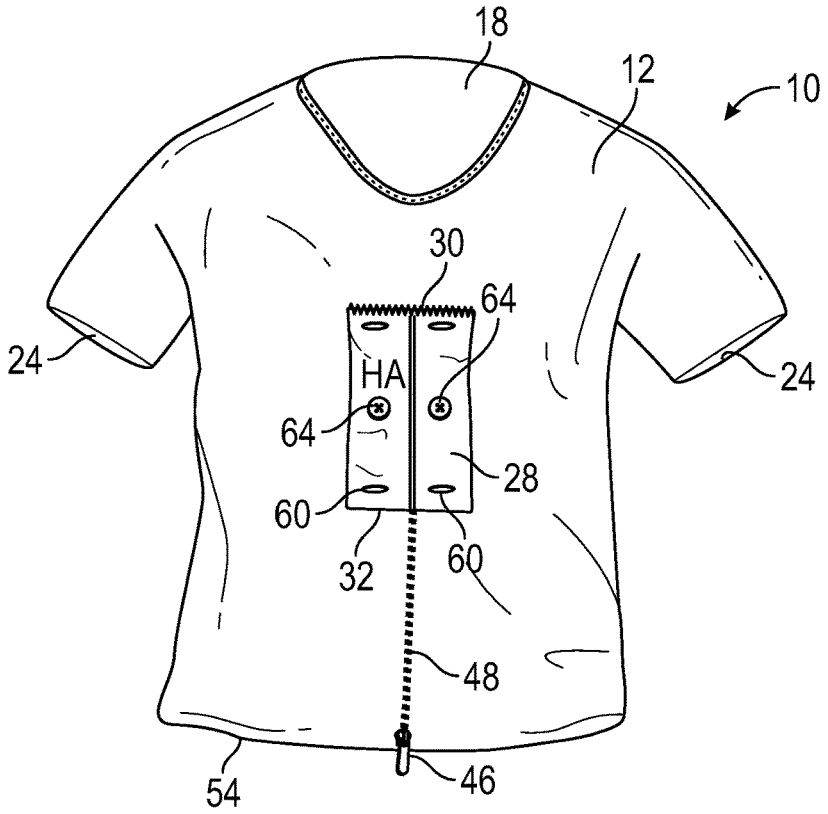
FIG. 1 is a perspective view of an intravenous tube compatible garment device according to an embodiment of the disclosure.

With reference now to the drawings, and in particular to FIGS. 1 through 8 thereof, a new medical tubing compatible garment embodying the principles and concepts of an embodiment of the disclosure and generally designated by the reference numeral 10 will be described.

As best illustrated in FIGS. 1 through 8, the intravenous tube compatible garment device 10 generally comprises a shirt 12. The shirt 12 is a top garment. The shirt 12 is a supple material 14. The shirt 12 can be a variety of supple materials 14 including cotton, silk, or microfiber. The shirt 12 has a front surface 16 and a top opening 18. The top opening 18 is configured for the head 22 of the user 20 to be inserted through. Additionally, the shirt 12 has a pair of arm holes 24. The pair of arm holes 24 is configured for being enwrapped around a respective one of a pair of arms 26 of the user 20. The shirt 12 is configured for being worn on the torso of a user 20 whereby the front surface 16 is positioned in front of the user 20.

A flap 28 is positioned on the front surface 16 of the shirt 12. The flap 28 is a rectangular shape and is the supple material 14. The flap 28 has a top edge 30 and a bottom edge 32 that are positioned parallel to each other. Furthermore, the flap 28 has a pair of side edges 34 that are positioned parallel to each other. The pair of side edges 34 is positioned perpendicular to the top edge 30 and the bottom edge 32. The top edge 30 is coupled to the front surface 16 of the shirt 12. The top edge 30 is configured for being stitched to the shirt 12, thus the bottom edge 32 being free to move relative to the top edge 30. A hidden area 36 is positioned between the flap 28 and the front surface 16 of the shirt 12. The hidden area 36 defines a space where an opening 38 is positioned. The opening 38 of the hidden area 36 can be accessed by flipping upward the bottom edge 32 of the flap 28 relative to the front surface 16 of the shirt 12.

The opening 38 is configured for an intravenous tube 40 to be inserted through opening 38 of the shirt 12. The intravenous tube 40 is a tubing used for medical purposes including administering medicine and other fluids to the user 20. The opening 38 facilitates the maneuvering of the intravenous tube 40 to the user 20 by going through the shirt 12 rather than going through the top opening 18 of the shirt 12. The hidden area 36 has a button 42 coupled to the front surface 16 of the shirt 12. The button 42 is coupled to the front surface 16 by sewing. The button 42 is configured to be inserted through a hole 44 in the flap 28 to retain the flap 28 to the shirt 12. The hole 44 of the flap 28 is an oval shape which helps with restraining the button 42 within the hole 44. The shirt 12 is configured for having either a single opening or a plurality of openings within a hidden area 36. Furthermore, the shirt 12 is configured for having either a single flap or multiple flaps.

Figure 2:
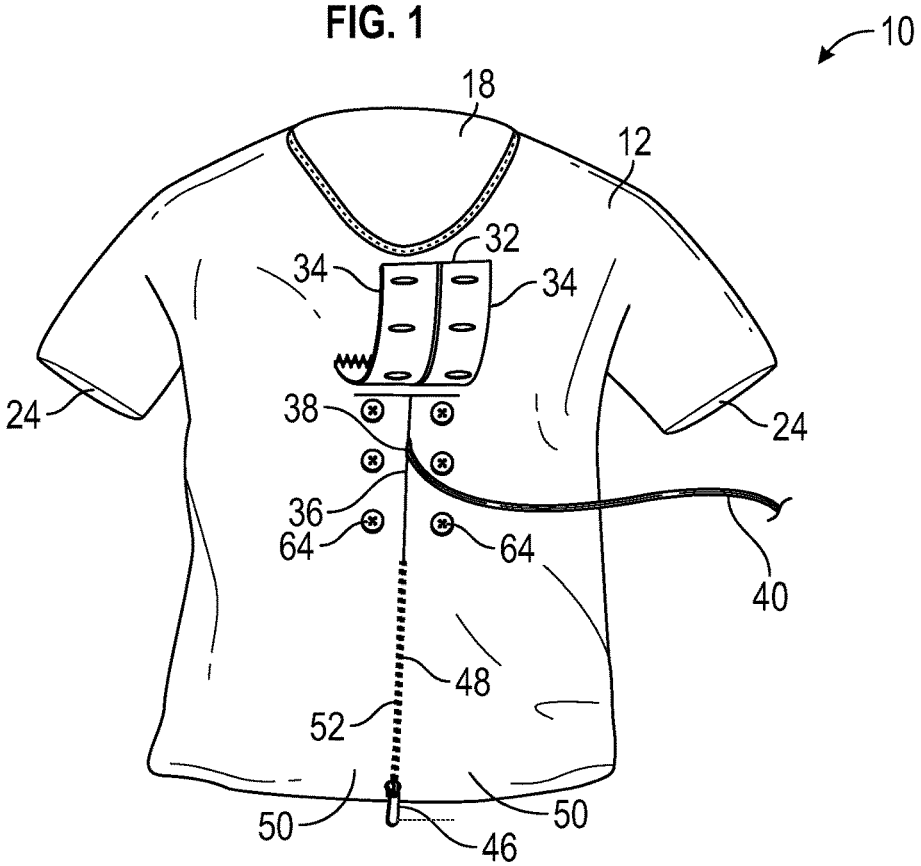
FIG. 2 is a perspective view of an embodiment of the disclosure.
Figure 3:
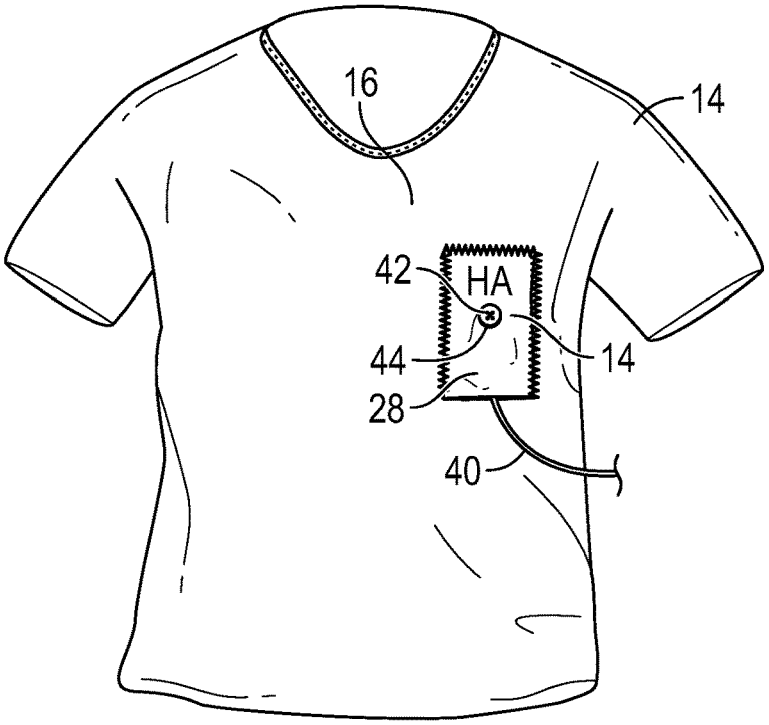
FIG. 3 is a perspective view of an embodiment of the disclosure.
Figure 4:
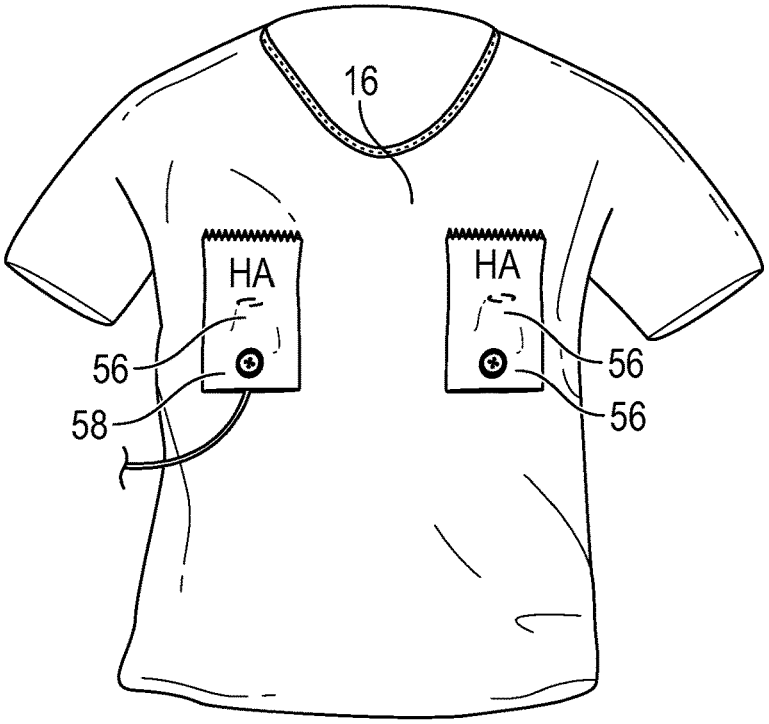
FIG. 4 is a perspective view of an embodiment of the disclosure.
Figure 5:
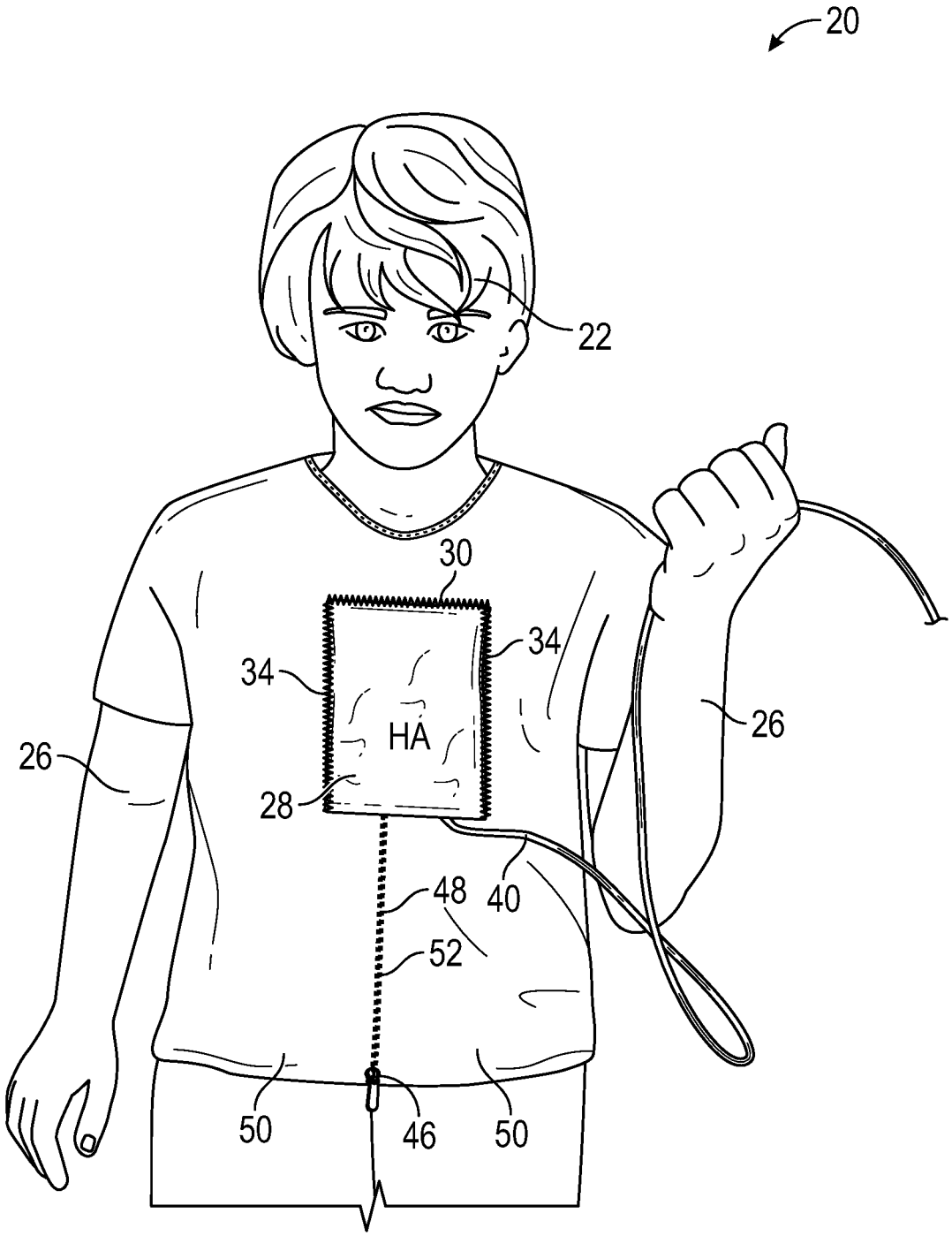
FIG. 5 is an in-use view of an embodiment of the disclosure.
Figure 6:
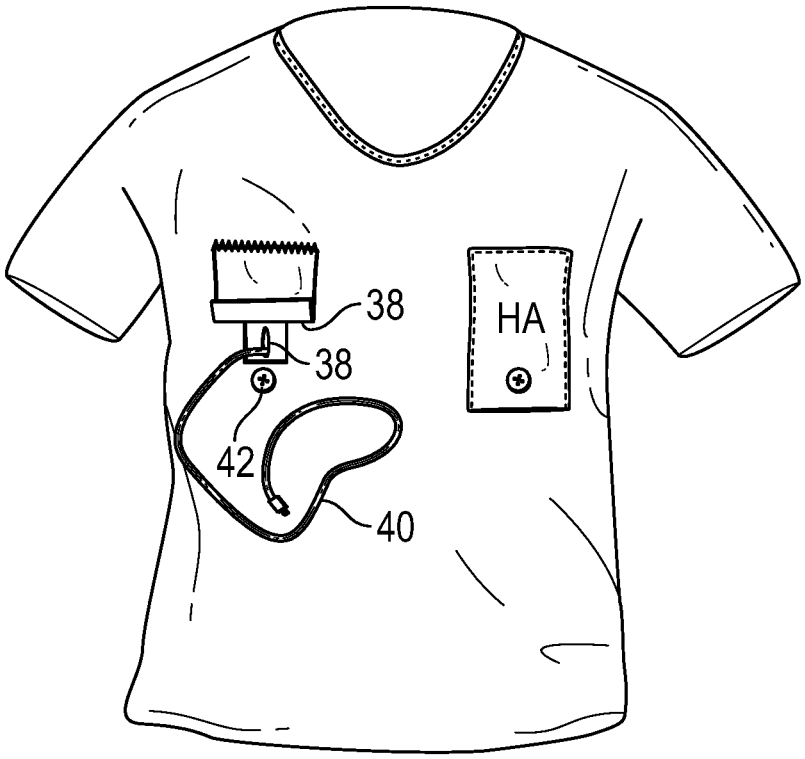
FIG. 6 is a perspective view of an embodiment of the disclosure.
Figure 7:
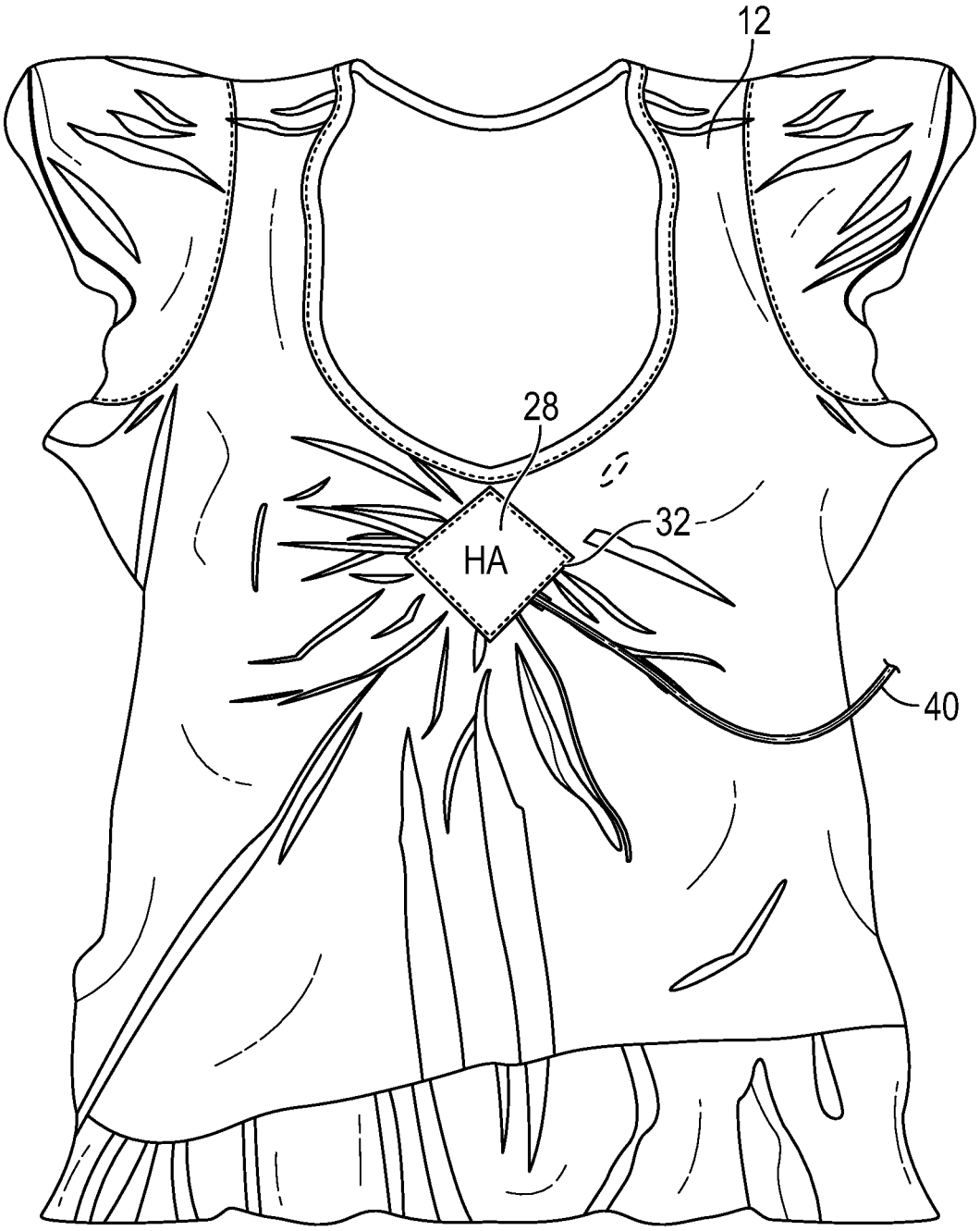
FIG. 7 is a perspective view of an embodiment of the disclosure.
Figure 8:
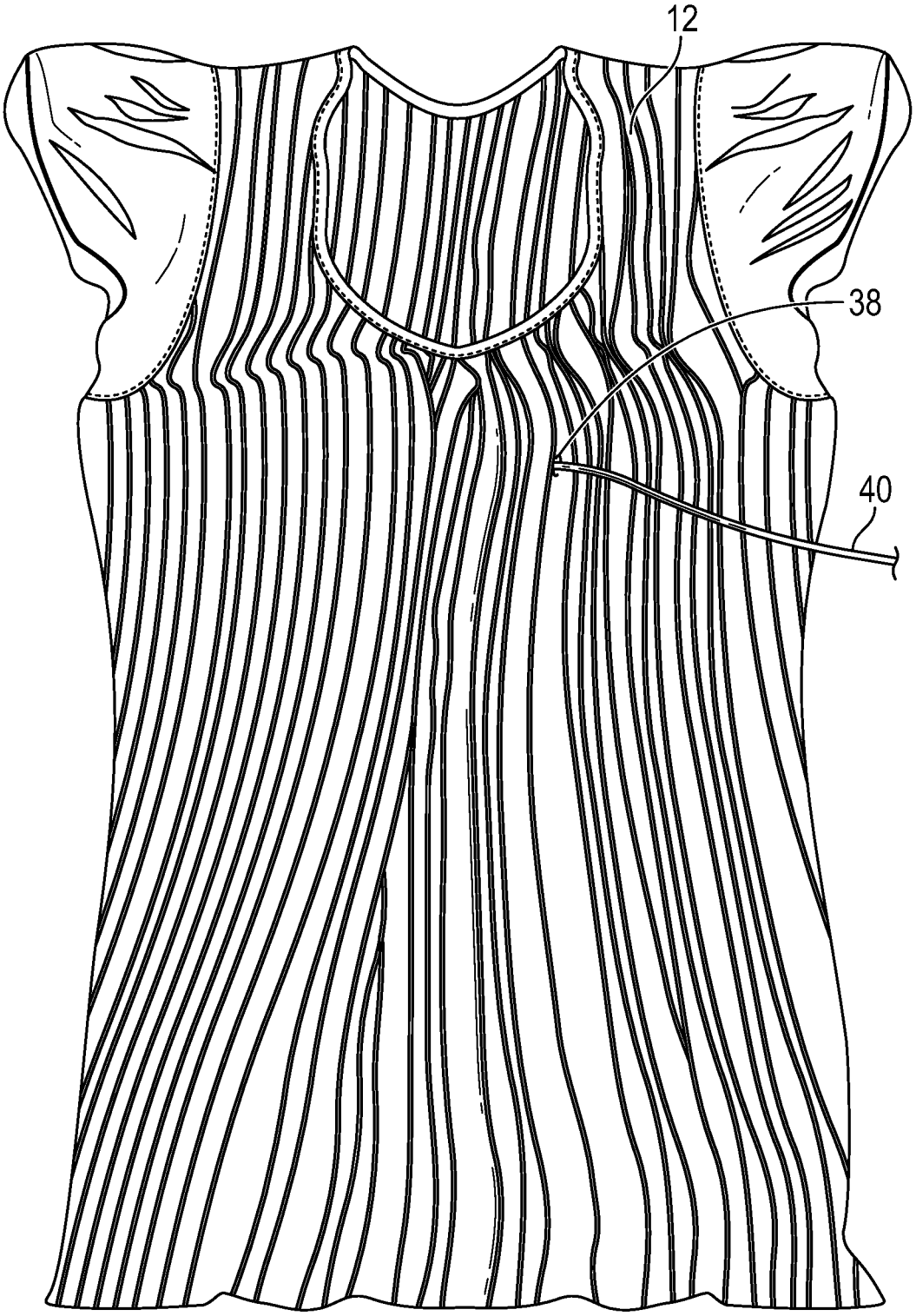
FIG. 8 is a perspective view of an embodiment of the disclosure.

A zipper 46 is shown in FIG. 1 and FIG. 2. The zipper 46 is a slide fastener. The zipper 46 has a path 48. The path 48 is a partition line having a pair of halves 50. Each of the halves 50 has a plurality of interlocking teeth 52. The zipper 46 is configured for sliding along the path 48 whereby securing the pair of halves 50 to each other using the plurality of interlocking teeth 52. The zipper 46 can unlock the plurality of interlocking teeth 52 of each of the halves 50 from each other by sliding in the opposite direction of the path 48. The zipper 46 is positioned on the front surface 16 of the shirt 12. The zipper 46 is positioned at a base 54 of the shirt 12 and protrudes towards the opening 38 of the hidden area 36 of the shirt 12. The zipper 46 provides supplement access for the intravenous tube 40 within the hidden area 36.

In use, the user 20 flips over the bottom edge 32 of the flap 28 to expose the hidden area 36. The user 20 can then thread the intravenous tube 40 through the opening 38 of the hidden area 36. After the intravenous tube 40 is in place, the user 20 can fasten the flap 28 to the shirt 12 using the button 42 coupled to the shirt 12 and the hole 44 of the flap 28. Variations of the intravenous tube compatible garment device 10 include a shirt 12 with a pair of flaps 56 thus having a pair of hidden areas 58 and lacking the zipper 46. Furthermore, variations of the intravenous tube compatible garment device 10 include a shirt 12 with a flap 28 having a plurality of holes 60 and a hidden area 36 having a plurality of openings 62 and a plurality of buttons 64. Another variation of the intravenous tube compatible garment device 10 comprises a flap 28 having the top edge 30 and each of the side edges 34 being stitched to the shirt 12 and lacking a button 42 and a hole 44 of the flap 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An intravenous tube compatible garment device comprising:

a shirt, said shirt being a top garment, said shirt having a front surface, said shirt being configured for being worn on the torso of a user whereby said front surface being positioned in front of the user;

a flap, said flap being positioned on said front surface of said shirt, said flap having a top edge and a bottom edge, said flap having a hole, said top edge being coupled to said front surface, a hidden area being positioned between said flap and said front surface, said hidden area defining a space where an opening being positioned, said opening being configured for an intravenous tube to be inserted through said opening of said shirt, said hidden area having a button, said button being configured for being inserted through said hole of said flap whereby retaining said flap to said shirt, said shirt being configured for having either a single or multiple openings; and a zipper, said zipper having a path, said zipper being positioned on said front surface of said shirt, said path of said zipper being positioned at a base of said shirt and protruding towards said opening of said hidden area of said shirt.

2. The intravenous tube compatible garment device of claim 1, further comprising said shirt being a supple material.

3. The intravenous tube compatible garment device of claim 1, further comprising said shirt having a top opening, said top opening being configured for the head of the user to be inserted through.

4. The intravenous tube compatible garment device of claim 1, further comprising said shirt having a pair of arm holes, said pair of arm holes being configured for being enwrapped around a respective one of a pair of arms of the user.

5. The intravenous tube compatible garment device of claim 1, further comprising said flap being a rectangular shape.

6. The intravenous tube compatible garment device of claim 2, further comprising said flap being said supple material.

7. The intravenous tube compatible garment device of claim 1, further comprising said flap having a pair of side edges, each of said side edges being parallel to each other.

8. The intravenous tube compatible garment device of claim 7, further comprising said pair of side edges being perpendicular relative to said top edge and to said bottom edge.

9. The intravenous tube compatible garment device of claim 1, further comprising said hole of said flap being an oval shape.

10. The intravenous tube compatible garment device of claim 1, further comprising said top edge being configured for being stitched to said front surface.

11. The intravenous tube compatible garment device of claim 1, further comprising said bottom edge being configured for flipping up to expose said hidden area.

12. The intravenous tube compatible garment device of claim 1, further comprising said opening being positioned on said front surface.

13. The intravenous tube compatible garment device of claim 1, further comprising said button being coupled to said front surface by sewing.

14. The intravenous tube compatible garment device of claim 1, further comprising said zipper being a slide fastener.

15. The intravenous tube compatible garment device of claim 1, further comprising said path being a partition line, said partition line having a pair of halves.

16. The intravenous tube compatible garment device of claim 15, further comprising each of said halves having a plurality of interlocking teeth.

17. The intravenous tube compatible garment device of claim 16, further comprising said zipper being configured for sliding along said path whereby securing said pair of halves to each other by said plurality of interlocking teeth.

18. An intravenous tube compatible garment device comprising:

a shirt, said shirt being a top garment, said shirt being a supple material, said shirt having a front surface, said shirt having a top opening, said top opening being configured for the head of the user to be inserted through, said shirt having a pair of arm holes, said pair of arm holes being configured for being enwrapped around a respective one of a pair of arms of the user, said shirt being configured for being worn on the torso of a user whereby said front surface being positioned in front of the user;

a flap, said flap being positioned on said front surface of said shirt, said flap being a rectangular shape, said flap being said supple material, said flap having a top edge and a bottom edge, said flap having a pair of side edges, each of said side edges being parallel to each other, said pair of side edges being perpendicular relative to said top edge and to said bottom edge, said flap having a hole, said hole being an oval shape, said top edge being coupled to said front surface, said top edge being configured for being stitched to said front surface, a hidden area being positioned between said flap and said front surface, said bottom edge being configured for flipping up to expose said hidden area, said hidden area defining a space where an opening being positioned, said opening being positioned on said front surface, said opening being configured for an intravenous tube to be inserted through said opening of said shirt, said hidden area having a button, said button being coupled to said front surface by sewing, said button being configured for being inserted through said hole of said flap whereby retaining said flap to said shirt, said shirt being configured for having either a single or multiple openings; and a zipper, said zipper being a slide fastener, said zipper having a path, said path being a partition line, said partition line having a pair of halves, each of said halves having a plurality of interlocking teeth, said zipper being configured for sliding along said path whereby securing said pair of halves to each other by said plurality of interlocking teeth, said zipper being positioned on said front surface of said shirt, said path of said zipper being positioned at a base of said shirt and protruding towards said opening of said hidden area of said shirt.

* * * * *